US008104472B2

(12) United States Patent
Henderson et al.

(10) Patent No.: US 8,104,472 B2
(45) Date of Patent: Jan. 31, 2012

(54) NON-ELASTOMERIC RESPIRATOR MASK THAT HAS DEFORMABLE CHEEK PORTIONS

(75) Inventors: Christopher P. Henderson, Brandon (GB); Audra A. Wilson, Gateshead (GB)

(73) Assignee: 3M Innovative Properties Company, St. Paul, MN (US)

( * ) Notice: Subject to any disclaimer, the term of this patent is extended or adjusted under 35 U.S.C. 154(b) by 539 days.

(21) Appl. No.: 10/810,958

(22) Filed: Mar. 26, 2004

(65) Prior Publication Data

US 2005/0211251 A1 Sep. 29, 2005

(51) Int. Cl.
*A62B 18/02* (2006.01)
*A62B 7/10* (2006.01)
*A62B 18/08* (2006.01)
*A62B 18/10* (2006.01)

(52) U.S. Cl. ..... 128/206.27; 128/205.25; 128/205.27; 128/206.12; 128/206.13; 128/206.17; 128/206.18; 128/206.21; 128/206.24; 128/206.28; 128/207.11; 128/207.12; 128/207.13

(58) Field of Classification Search ..... 128/205.25, 128/205.27, 205.29, 206.12, 206.13, 206.17, 128/206.18, 206.21, 206.24, 206.27, 206.28, 128/207.11, 207.12, 207.13
See application file for complete search history.

(56) References Cited

U.S. PATENT DOCUMENTS 2,652,828 A 9/1953 Matheson
3,118,445 A 1/1964 Norman
4,155,358 A 5/1979 McAllister et al.
4,579,113 A * 4/1986 McCreadie et al. ..... 128/202.13
4,960,121 A * 10/1990 Nelson et al. ..... 128/206.24
5,062,421 A 11/1991 Burns et al.
5,592,937 A 1/1997 Freund
(Continued)

FOREIGN PATENT DOCUMENTS

EP 0258508 A1 3/1988
(Continued)

OTHER PUBLICATIONS

U.S. Appl. No. 29/201,444 to Wilson et al., filed Mar. 16, 2004 and entitled *Filter Cartridge*.

(Continued)

*Primary Examiner* — Patricia Bianco
*Assistant Examiner* — Nihir Patel

(57) ABSTRACT

A respiratory mask (10) that comprises a mask body (12) and a harness (21) that includes a carriage (22) and a strap (24). The mask body (12) lacks a rigid insert, is non-elastomeric, and is adapted for fitting over a person's nose and mouth. The mask body (12) has a nose portion (14), a chin portion (16), first and second cheek portions (18 and 20), and an axis (32) that extends from the nose portion (14) to the chin portion (16). The mask body (12) is constructed to deform such that the first and second cheek portions (18 and 20) move towards each other about the axis (32). The carriage (22) is joined to the mask body (12), and the strap (24) is joined to the carriage (22) for supporting the mask body (12) over a person's nose and mouth. When tension is applied to the strap (24) and an opposing force acts at the nose and chin portions of the mask body, the first and second cheek portions (18, 20) exhibit movement about the axis (32) towards each other. The respirator mask is beneficial in that it is lightweight, easy to manufacture, and maintains a good fit to a person's face.

33 Claims, 3 Drawing Sheets

U.S. PATENT DOCUMENTS

| | | | | |
|---|---|---|---|---|
| 5,617,849 | A * | 4/1997 | Springett et al. | 128/206.24 |
| 5,856,400 | A | 1/1999 | Matsumura et al. | |
| 6,016,804 | A | 1/2000 | Gleason et al. | |
| 6,062,221 | A * | 5/2000 | Brostrom et al. | 128/206.27 |
| 6,277,178 | B1 | 8/2001 | Holmquist-Brown et al. | |
| 6,457,473 | B1 | 10/2002 | Brostrom et al. | |
| 6,575,165 | B1 | 6/2003 | Cook et al. | |
| 6,591,837 | B1 | 7/2003 | Byram | |
| 2002/0195108 | A1 | 12/2002 | Mittelstadt et al. | |
| 2002/0195109 | A1 | 12/2002 | Mittelstadt et al. | |
| 2004/0055604 | A1 | 3/2004 | Viner et al. | |

FOREIGN PATENT DOCUMENTS

| | | |
|---|---|---|
| EP | 0309277 A2 | 3/1989 |
| JP | H11-506621 | 6/1999 |
| JP | 2002-239018 | 8/2002 |
| JP | 2002-537078 | 11/2002 |
| KR | 230318365 | 6/2003 |
| WO | 96/40370 | 12/1996 |
| WO | 00/50122 | 8/2000 |

OTHER PUBLICATIONS

U.S. Appl. No. 29/201,509 to Martin, filed Mar. 16, 2004 and entitled *Face Mask Carriage*.

U.S. Appl. No. 10/719,959 to Flannigan et al., filed Nov. 21, 2003 and entitled *Respiratory Facepiece and Method of Making a Facepiece Using Separate Molds*.

Basell Polyolefins Adflex Q 100 F literature.

* cited by examiner

NON-ELASTOMERIC RESPIRATOR MASK THAT HAS DEFORMABLE CHEEK PORTIONS

The present invention pertains to a respirator that has a mask body that maintains a good fit on a person's face by easily deflecting inward at the cheeks.

BACKGROUND

Respirator facepieces have been made from a soft compliant material, commonly rubber, that rests against the wearer's face and forms a seal against the wearer's facial skin. The rubber typically is thick so that it can support filters and exhalation valves. See, for example, U.S. Pat. No. 2,652,828 to Matheson and U.S. Pat. No. 4,155,358 to McAlister et al. Thick rubber facepieces, however, can make the respirator heavy and uncomfortable to wear. Additionally, thick rubber adds to material and manufacturing costs. If the rubber is made thinner, however, the mask may have a tendency to collapse onto the user's face, particularly when tightening the harness while donning the respirator.

To make a facepiece lighter but not at the expense of reducing structural integrity, a thin rigid structural part has been incorporated into the facepiece. These rigid structural parts are commonly produced through injection molding and are often referred to as a "rigid insert". The rigid insert provides adequate structure for supporting filter cartridges and valves. A soft compliant material, which conforms to a person's face, is disposed on or about the rigid insert to enable the mask to fit snugly over the wearer's nose and mouth. The use of a rigid insert in conjunction with a soft compliant portion tends to make the mask lighter and more comfortable to wear, particularly when compared to the previous masks that had used thick rubber throughout essentially the whole mask body to support the filter cartridges and valves. Masks that use a rigid insert in conjunction with a compliant face-contacting member are shown in U.S. Pat. No. 6,016,804 to Gleason et al., U.S. Pat. No. 5,592,937 to Freund, U.S. Pat. No. 5,062,421 to Burns et al., and in U.S. patent application Ser. No. 10/719,959 filed Nov. 21, 2003, entitled "Respiratory Facepiece And Method Of Making A Facepiece Using Separate Molds."

Although masks that employ rigid inserts in conjunction with a soft compliant portion tend to be lighter and more comfortable to wear, they nonetheless can be somewhat more complicated to manufacture. Masks that use rigid inserts require multiple parts and the additional step of hermetically joining the insert to the soft, compliant, face-contacting portion. The need for these additional parts and assembly steps can add to manufacturing costs.

SUMMARY OF THE INVENTION

The present invention provides a new respiratory mask that can overcome the need for thick facepieces, multiple parts, and multiple manufacturing steps to create the mask body. Unlike known respirators that used a thick rubber face piece to enable the cartridges to be adequately supported, the present invention may employ a thinner material that is sufficiently rigid and yet deformable at the cheeks so that the mask can adequately support filter cartridges and yet be sufficiently pliable to enable the mask to fit snugly and comfortably over a person's nose and at the cheek and chin portions. And unlike masks that used a rigid insert and a soft compliant portion, the present invention can make good contact to a wearer's face without using multiple facepiece parts and multiple manufacturing steps.

In brief summary, the present invention provides a respiratory mask that comprises a mask body that lacks a rigid insert, that is non-elastomeric, and that is adapted for fitting over a person's nose and mouth. The mask body has a nose portion, a chin portion, first and second cheek portions, and an axis that extends from the nose portion to the chin portion. The mask body is constructed to deform such that the first and second cheek portions can move towards each other about the axis when the mask body is held stationary and a force is exerted on the nose and chin portions. The respiratory mask also includes a harness that assists in supporting the mask on a wearer's face.

As indicated, previously known masks achieved a good fit over the nose and around the cheeks and chin by using either thick elastomeric rubber or a rigid insert in conjunction with an elastomeric type face seal. The present invention, in contrast, does not possess a rigid structural insert to enable filter elements and valves to be adequately attached to the mask body but yet is able to provide a good fit at the cheek regions of a wearer's face, as well as over the nose and around the chin. The inventive mask body exhibits substantial deflection about an axis that extends from the nose portion to the cheek portion of the mask. When tension is placed upon the straps that support the mask body on a wearer's face, and an opposing force is exerted at the nose and chin portions—as would occur when the mask is being worn—the cheek portions deflect inwardly towards each other. This form of deflection enables a good fit to be achieved on the wearer's face. This fit can be maintained during jaw movement of the wearer. For example, if a mask user is speaking while wearing the mask, adequate contact between the mask and the cheek portions can still be achieved. When using the inventive mask, an extension of the jaw draws the cheek portions toward each other so that a tight fit is still maintained.

These and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

GLOSSARY

The terms used in this document will have the meanings as set forth below:

"Carriage" means a structural part (and/or combination of parts) that attaches to strap(s) and a mask body and assists in supporting a mask body on a wearer's face when in use;

"Central portion" means the portion of the mask body located generally centrally between the nose, chin and cheek portions of the mask body;

"Cheek portion" means the portion of the mask body that is disposed over and may be in contact with the cheek area of a wearer's face when the mask body is worn;

"Chin portion" means the portion of the mask body that is disposed over and may be in contact with the chin area of a wearer's face when the mask body is worn;

"Elastic limit" means the limit of distortion that a material can undergo and still return to its original form when relieved from stress;

"Exterior gas space" means the ambient atmospheric gas space that surrounds a mask body when worn on a person and that ultimately receives exhaled gas after it exits the interior gas space of a mask;

"Flexural Modulus" means the flexural modulus determined in accordance with ASTM 790-03, Standard Test Methods for Flexural Properties of Unreinforced and Reinforced Plastics and Electrical Insulating Materials;

"Harness" means a device that forms part of a respiratory mask and serves to support the mask on a person's face;

"Integral" means made at the same time as one piece and not two or more separately made parts that are subsequently joined together;

"Interior gas space" means the space that exists between a mask body and a person's face when the mask is being worn;

"Mask body" means a structural member that is configured to fit over a person's nose and mouth and that helps define an interior gas space separate from an exterior gas space;

"Non-elastomeric" means a material that has an elongation at its elastic limit of less than about 10%;

"Nose portion" means the portion of a mask body that extends over the bridge of a person's nose when the mask is being worn;

"Respiratory mask" means a device that is adapted to be worn on the face of a person for supplying that person with clean filtered air;

"Rigid insert" refers to a relatively stiff structural member that has been used on respiratory masks to provide adequate structure for attaching fluid communication components such as filter cartridges and exhalation valves while being joined to a more compliant portion that makes contact with and generally conforms to a wearer's face; and "Strap" means an elongated narrow strip or cord of pliant material.

DETAILED DESCRIPTION OF PREFERRED EMBODIMENTS

In the practice of the present invention, a new respiratory mask is provided that can be lightweight, that can be easy to assemble, that can require relatively few parts, and that can be capable of maintaining good facial contact to a wearer's face.

Figure 1:
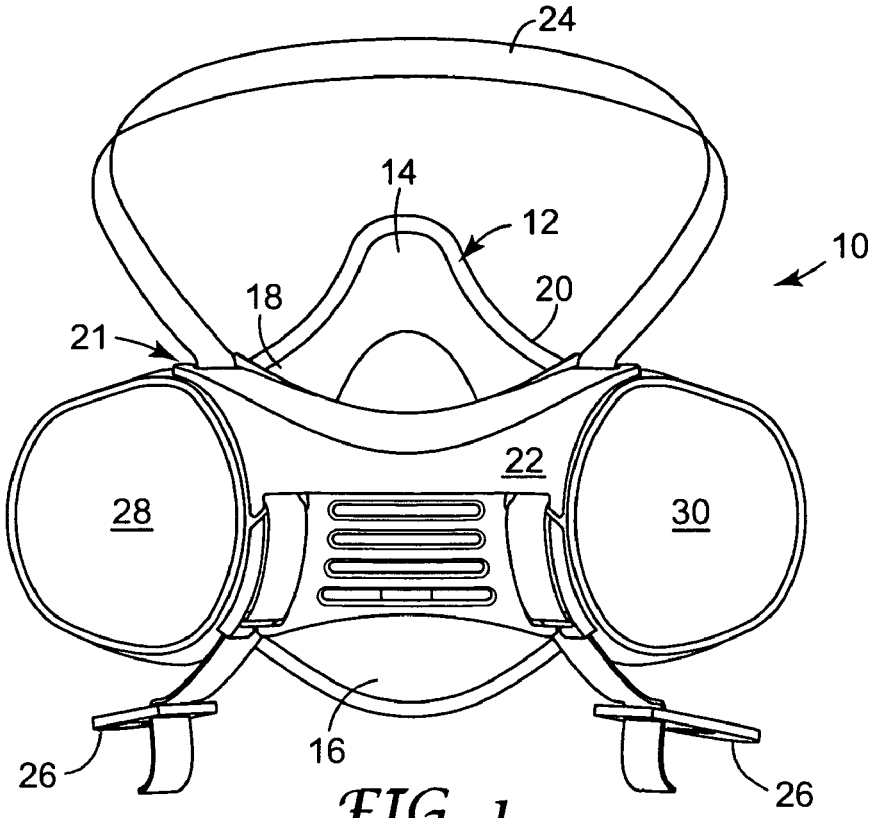
FIG. 1 is a front view of a respiratory mask 10 in accordance with the present invention.

FIG. 1 shows a respiratory mask 10 that has a mask body 12 that includes a nose portion 14, a chin portion 16, and first and second cheek portions 18 and 20, respectively. Mask 10 fits over a wearer's nose and mouth but not over their eyes, and hence is often referred to as a "half mask". A harness 21 that includes a carriage 22 is attached to the mask body 12 at the location of a central opening (not shown). An exhalation valve (also not shown) is disposed in the central opening to enable exhaled air to be purged from the mask interior. The harness 21 also includes at least one strap 24 that is attached to the carriage 22 to assist in supporting the mask body 12 on the face of a wearer when in use. Strap 24 may engage a buckle 26 that enables open ends of the strap to be secured together for maintaining a proper fit over the person's nose and mouth. The strap 24 may be slidably threaded through guide-ways in the carriage 22 so that its length can be adjusted accordingly. The strap also could be permanently attached if desired. Respiratory mask 10 also includes first and second filter cartridges 28 and 30 for filtering air before it is inhaled by the wearer. The filter cartridges 28 and 30 may include particulate and/or gaseous filter media for removing vapors and/or airborne particulates, respectively. Because the wearer's lungs are used to draw breathable air through the filter cartridges, the mask 10 is referred to as a "negative pressure" half mask.

Figure 2:
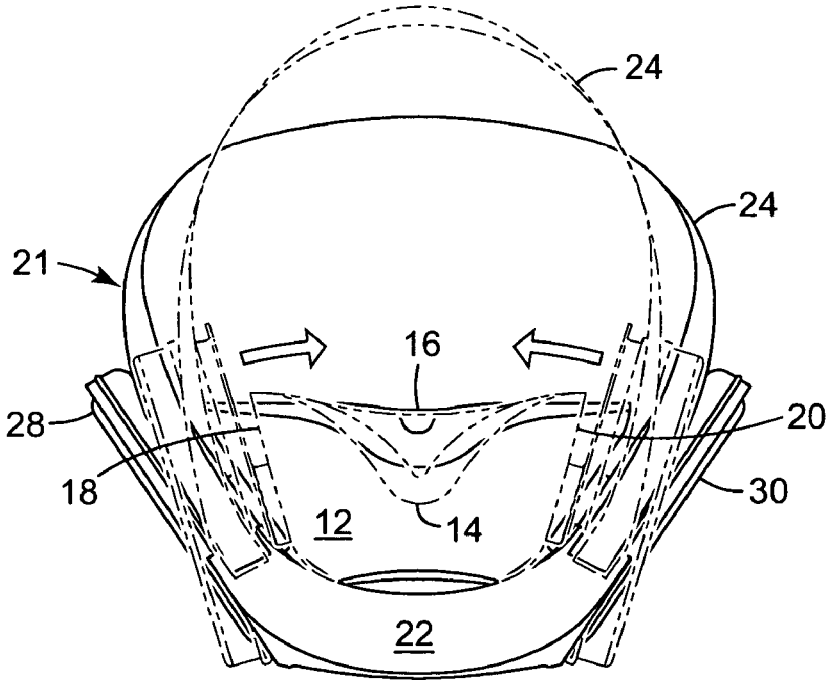
FIG. 2 is a top view of a respiratory mask 10 in accordance with the present invention, illustrating the deflection of the first and second cheek portions 18 and 20.

FIG. 2 illustrates how the first and second cheek portions 18 and 20 of the mask body 12 can deflect inwardly to enable a better fit to be achieved by a mask wearer. In FIG. 2 (and in FIG. 3), the solid line representation shows the mask in a nondeflected condition, whereas the phantom line representation illustrates the mask configuration in deflected condition. The cheek portions 18 and 20 deflect in the direction of the arrows when an opposing force is applied at the nose and chin portions 14 and 16 of mask body 12. The force that is exerted upon nose portion 14 and chin portion 16 may occur when the mask is placed on the face of a wearer and tension is applied from strap(s) 24. The deflection may occur even though the straps do not directly "tug" on cheek portions 18 and 20. The inward deflection of cheek portion 18 and 20 helps ensure that the mask body 12 maintains a proper fit to a wearer's face. This feature can preclude contaminants from inadvertently entering the mask's interior gas space when the mask is being worn.

Because the carriage 22 is centrally mounted on the mask body 12, the force from the tension on the strap(s) 24 acts centrally on the mask body 12 and hence pushes it in a generally uniform manner towards the wearer's face. Although the carriage 22 could be fashioned in accordance with this invention such that the straps exert a non-centrally acting force on the mask body (such as on the sides of the mask body), the inventive mask body nonetheless has the ability to draw the cheek portions 18 and 28 inwardly despite an absence of such an attachment. Other carriages are contemplated under this invention and may be attached at other locations. Examples of other carriages that may be suitable are described in, for example, U.S. Pat. No. 5,062,421 to Burns et al., U.S. Pat. No. 5,592,937 to Freund, U.S. Pat. No. 6,591,837 to Byram, and U.S. Pat. No. 6,457,473 to Brostrom et al. Alternatively, the straps could be connected to the cheek portions (see, e.g., U.S. Pat. No. 6,016,804 to Gleason et al.)—although not necessary in this invention for drawing the cheek portions against the wearer's cheeks.

Figure 3:
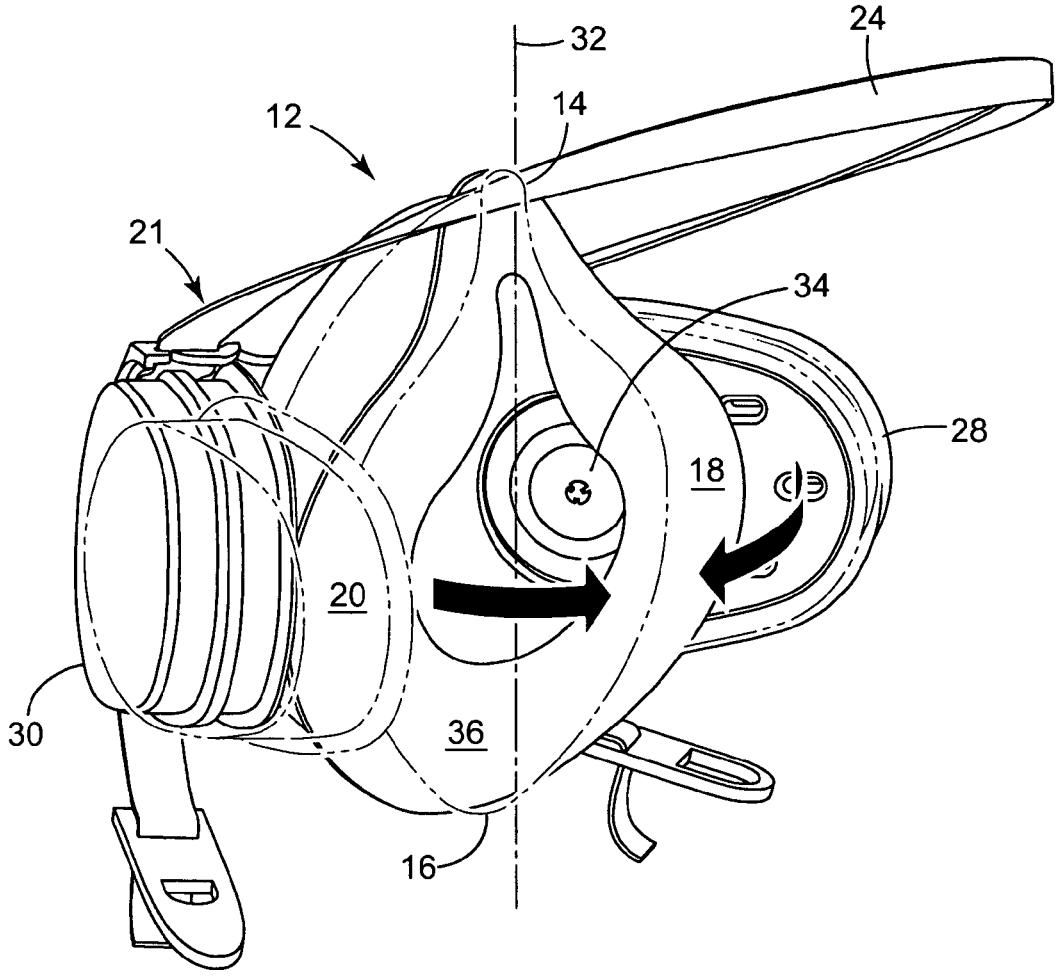
FIG. 3 is a rear perspective view of a respiratory mask 10 in accordance with the present invention also illustrating the deflection of the first and second cheek portions 18 and 20.

FIG. 3 illustrates the deflection of the cheek portions 18 and 20 about an axis 32 that extends from the nose portion 14 to the chin portion 16. As shown, cheek portions 18 and 20 rotate about the axis towards each other when the cheek portions are in their deflected position. The first and second filter cartridges 28 and 30, which are attached to the mask body at the cheek portions 18 and 20, likewise move inwardly with the cheek portions 18 and 20, respectively. The deflection occurs as a result of the force exerted at nose and chin portions 18 and 20, respectively. In this illustrated embodiment, this happens as a result of tension from strap 24 being transferred to carriage 22 and creating a force that acts at the central portion of the mask, pushing mask body 12 against a wearer's face at the nose and chin portions where an opposing force acts.

As is typical in a respiratory mask construction, the filter cartridges are joined on opposing sides of the mask body and have an inhalation valve 34 located where the filter cartridges are secured to the mask body. When using a respiratory mask 10, the wearer's lungs draw air from the ambient environment through the filter cartridges 28 and 30 and hence through the inhalation valves 34 so that air can enter the interior gas space. This filtered air subsequently becomes inhaled by the wearer. Exhaled air then passes out an exhalation valve (not shown) to enter the exterior gas space. The exhalation valve is disposed centrally on the mask body 12 behind the carriage 22. To insure that all inhaled air is filtered before being breathed by a wearer, it is important that the mask body maintain a tight or generally hermetic fit to a wearer's face. The present invention—because of its ability to have the cheek portions deflect inwardly as shown in FIGS. 2 and 3—can enable such a fit to be achieved so that little or no air leakage occurs around the perimeter of the mask body. As FIG. 3 illustrates, the mask body also may include a perimeter face seal 36 made from a soft, deformable, material such as an elastomer or thin thermoplastic film to further allow a comfortable secure fit to be achieved. Additionally, a foam material (not shown) may be applied to the mask body interior at the nose portion 14 for additional comfort and to improve the seal over the wearer's nose. The foam can also push the face seal into concave areas of the face on some users when the mask is worn.

Although the invention has been illustrated as a half mask that has first and second filter cartridges, the respiratory mask may come in other forms. For example, the mask could have a single filter cartridge, centrally mounted as shown, for example, in U.S. Pat. No. 6,277,178 to Holmquist-Brown. Additionally, the invention could be used in connection with a powered-air supply source, which would have a clean air hose attached to the mask body rather than filter cartridge(s) see, for example, U.S. Pat. No. 6,575,165 to Cook et al. In this instance, the mask body would be provided with a mechanism that allows for attachment of a powered air supply source, which mechanism could be, for example, a bayonet fitting that could also allow for optional filter cartridge attachment.

The mask body that is employed in the present invention is non-elastomeric. Preferably, the material used to make the mask body has an elongation at its elastic limit (that is, the greatest stress which a material is capable of sustaining without permanent strain remaining, upon the complete release of the stress) of less than about 5 percent, more preferably less than about 2 percent, and still more preferably less than about 1 percent. A material is said to have passed its elastic limit when the load is sufficient to initiate plastic, or nonrecoverable deformation. Preferably the material from which the mask body is made has a Flexural Modulus of greater than about 50 Mega Pascals (MPa), more preferably greater than about 500 MPa, and still more preferably greater than about 1000 MPa. At the upper end, the mask body has a Flexural Modulus of less than about 4000 MPa. When wearing a respiratory mask, the straps typically apply a force of about 10 to 20 Newtons (N) to enable the mask to be adequately fitted over the nose and mouth of a person. When tested in accordance with the Mask Body Deflector Test described below, the mask body preferably exhibits a deflection of at least 5 millimeters (mm) when a force of 5 N is applied to the mask body. More preferably, the inventive mask will exhibit a deflection of at least 10 mm when a force of 5 N is applied to the mask in accordance with the Mask Body Deflection Test set forth below. The mask body that is used in the present invention (absent any attachments such as valves, cartridges, harnesses, face seal and foams, and gaskets—referred to herein as a "naked mask body") preferably is lightweight and does not weigh more than about 35 grams, more preferably no more than 30 grams, and still more preferably no more than 25 grams. Typically, the naked mask body will have a weight that is greater than 10 grams. In addition, the mask body preferably is relatively thin and preferably has an average thickness less than about 2 mm, more preferably less than 1.6 mm, and still more preferably less than 1.2 mm. At the lower end, the mask body has a thickness that typically is greater than about 0.5 mm.

The mask body can be constructed from a plastic such as a polymeric material like a thermoformable polypropylene that is formed over a male mold of the desired shape. The term "polymeric" is used herein to mean containing a polymer. Examples of other polymers that may be used include polyethylenes, polyethylene terephthalates, polyvinylchlorides, styrenic resins, polyurethanes, fluoropolymers, cellulosics, and combinations and perhaps blends of such polymers. In addition to thermoforming, the mask body could be made by other plastic forming techniques such as injection molding. A thermoformed mask body can be provided with planar circular openings, the central one of which protrudes from the central portion of the mask body to create a cylindrical "up-stand" or ridge. The remaining two flat openings are situated in the opposing cheek portions of the mask body. The mask body can be fashioned as an integral body or cup that, as a whole, may be molded out of a surface that becomes suitably shaped to generally fit the contours of the human face. This cup may be subjected to a secondary operation (piercing) to remove material from the mask body to create openings for the exhalation and inhalation valves and filter cartridge attachment.

The mask body can be molded to impart structural reinforcement in the areas where attachments occur. For example, concentric rings or ridges may be formed about the areas where the openings are located to cause the mask body to be stiffer in these locations so that the cup does not collapse or deviate inwardly or otherwise in response to weight (or perhaps bumping) of the filter cartridges or the carriage.

To allow the mask body to be properly used in contaminated environments and to pass the necessary fit and performance tests for such use, components such as inhalation valves, a harness or head suspension system, face seal, gaskets, and filter cartridges can be attached to the mask body. As discussed above, the harness carriage can be mounted centrally to the mask body. The carriage can provide a protective cover for the exhalation valve, while leaving two generally planar circular openings in the cheek regions exposed. The carriage can be connected to the mask body by a circular structure that is disposed on the underside of the cylindrical up-stand formed in the mask body. The carriage can be retained in place by inserting, for example, an exhalation valve base, which can be an injection-molded part, into the central opening defined by the up-stand. The exhalation valve base can be inserted from the interior side of the mask body into the cylindrical opening defined by the up-stand. The exhalation valve base can likewise be cylindrical and fit snugly within the sleeve defined by the cylindrical up-stand. A radially-extending flange can be furnished on the base to assist in drawing the carriage tightly against the mask body. The exhalation valve base extends from the inside of the mask body into the up-stand, trapping the mask body between the two. The exhalation valve base may further be designed to retain and provide a sealing surface for an exhalation valve diaphragm, which diaphragm is retained on the base by a molded central stake that is inserted through a hole in the diaphragm. The parts can be shaped such that an interlocking action occurs.

The attached harness may also include, for example, an elastic strap that is threaded through the guide-ways in the carriage. The strap could be, for example, braided, knitted, rubber, leather, or the like and may take essentially any form that assists in supporting the mask body on a person's face. The straps preferably are elastic and may be further joined to a crown member, head cradle, or pad.

The filter cartridges can be constructed as described in U.S. patent application Ser. No. 10/252,623 filed on Sep. 23, 2002, entitled "Filter Element That Has A Thermoformed Housing Around A Filter Material." The filter cartridges can be thermally bonded to the two flat circular portions located in the opposing cheek regions of the mask body. This central connection can be achieved by simultaneously heating the mating surfaces of both the mask body and the filter cartridge housing, and when at the desired temperature, removing the heat source and placing the parts together until cooled. The invention contemplates essentially any manner of attaching the cartridges to the mask body using, for example, chemical, mechanical, or other suitable means. The attachment may be permanent, or the cartridges could be removable to allow for replacement. The filter cartridges may contain gaseous and/or particulate filter media. Examples of gaseous filter media can include beds of active particulate such as described in U.S. Pat. No. 6,391,429 to Senkus et al., U.S. Pat. No. 6,344,071 to Simon et al., and U.S. Pat. No. 5,496,785 to Abler. U.S. Pat. No. 6,627,563 to Huberty, U.S. Pat. No. 6,562,112 to Jones et al., U.S. Pat. No. 6,492,286 to Berrigan et al., and U.S. Pat. No. 6,454,986 and U.S. Pat. No. 6,406,657 to Eitzman et al. disclose examples of particulate filter media (for example, nonwoven fibrous web electrets of melt-blown microfibers) that could be used in the filter cartridge.

Mask Body Deflection Test

Mask body deflection was determined by placing a load on the mask that would mimic the loading forces imparted to a facemask when worn. Lateral deflection of the mask body, in response to a load applied to its nose and chin portions, was measured while the body was supported on the outward facing exterior of the mask. Load was recorded as a total force in N, and the deflection was recorded in mm. Deflection measurements of the mask body were taken at a location on the body that corresponded to the face-fit opening of the mask body between two points at the outer perimeter of the cheek portions. Load was applied to the mask body along an axis defined by the nose and chin portions.

Tests were made using a modified tensile test machine (LLOYD Instruments LRX5K, Fareham, United Kingdom) equipped with a 2500 N load cell mounted to the upper cross-head. A downward extending T-shaped extension probe was fitted to the load cell. The bottom of the 160 mm long probe had a cylindrical rod (12.5 mm outside diameter) mounted at its center, which rod was oriented perpendicular to direction of the cross head movement. The rod was of a length greater than the distance between the nose and chin portions of the mask body and was aligned with the nose and chin portions when the mask body was mounted on the lower fixture of the tensile tester. The lower fixture of the tensile tester was a round, 10 centimeter (cm) diameter, plate affixed so that the plane of the plate was parallel to the rod of the extension probe on the upper cross-head.

The outer face of the mask body to be tested was centered on the bottom fixture plate with the opening of the mask body facing the upper cross-head. The mask body was further oriented so that, when the cross-head was indexed downward, the bar on the load cell probe aligned with the nose and chin portion of the mask body. The mask body was mounted to the bottom plate using putty or hot-melt adhesive to assure that it retained its orientation through the test. To conduct a deflection measurement, the upper cross head was lowered until the perpendicular rod just contacted the nose and chin portions of the mask body. The distance between the outermost edge of the mask body and the perpendicular rod mounting was measured; this was taken as zero deflection. The cross head was further lowered (head speed 10 mm/min) and the change in distance between the outermost edge of the mask body was measured. This procedure was repeated until a profile of deflection verses load was determined for several load levels.

The following Example has been selected merely to further illustrate features, advantages, and other details of the invention. It is to be expressly understood, however, that while the Example serves this purpose, the particular ingredients and amounts used as well as other conditions and details are not to be construed in a manner that would unduly limit the scope of this invention.

EXAMPLE

The respiratory mask shown in the drawings was assembled using a non-elastomeric mask body, an elastomeric face sealing ring, a valve body, a valve cover, a carriage, a foam nose bridge, filter cartridges, and a harness. The mask body was formed from a 1.5 mm thick sheet of thermoformable polypropylene (PP) ("Adflex" Q100F from Basell Polyolefins Company Hoofddorp Netherlands) using a vacuum forming device (available from Formech International Ltd Harpenden UK). Material used to form the mask body had a flexural modulus of 1172 MPa and a softing point of 170° C. To mold the mask body, a 30 cm×27 cm section of thermoformable PP sheet was positioned in a frame fixture and heated to approximately 170° C. (the softening point of the material) and placed over the mold form. The mold form, mounted on a flat surface approximating the inner dimensions of the frame fixture, was then raised into the softened sheet and a vacuum was provided through ports on the mold and support surface so that the sheet was caused to draw down onto the mold, making a close fit between the mold and sheet. After cooling, the sheet was separated from the mold, and 21 mm diameter ports were cut into the mask body to provide for the attachment of filter cartridges. Additionally, a 38 mm port on the front of the cup was cut into the mask body to allow for attachment of the exhalation valve and carriage assembly. Excess material was trimmed from the perimeter of the mask body, leaving a 3 to 10 mm perimeter rim or flange that protruded therefrom. The mask body had a generally planer face fitting opening that has a maximum external width about 140 mm and a depth of 60 mm. Thickness of the finished mask body was on average about 1.2 mm, and the naked mask body weighed about 20 g. Attached to the flange around the perimeter was elastomeric face seal ring. The annular face seal ring was cut from a sheet of 0.3 mm thermoplastic elastomer ("Laprene" 83F000746 from SoFtr SpA, Forli, Italy) and thermally bonded to the rim of the cup by protecting the elastomer surface with a polytetrafluorotheylene (PTFE) sheet and applying pressure and heat. The seal ring width was nominally 30 mm, which provided for an opening to the mask body interior of approximately 70 mm. A carriage that included an exhalation valve cover and a headband attachment element was attached to the mask's central portion to act as a loading point for the headband assembly when tension is applied. A valve like that used in 3M 6000 series Gas & Vapor respirator was attached to the central portion of the mask body using a cylindrical connection feature. The valve and diaphragm assembly was fitted through the inside of the mask body into a circular centrally disposed up-stand. The assembly was retained in place by inserting an injection-molded part (made from (Stamylan P 48M10 PP SABIC, EuroPetrochemicals B.V., Sittard, Netherlands) over the up-stand. The valve cover was shaped such that it has cylinder shaped element on the underside that fits over the up-stand on the central portion of the mask body, trapping the mask body material between it and the valve and diaphragm assembly. Mounted on the top of this cylindrical element was generally perpendicular structure that had concaved elements in its sides to accommodate the filters and guide-way features that retained the headbands. The valve component was designed to retain and provide a sealing surface for an silicone diaphragm valve.

A carriage was affixed to the mask body at the valve assembly point. The suspension system consisted of a 1 m length of 12 mm wide twelve-strand braided cotton/polyester/PIP elastic (Providence Braid Company, Pawtucket, USA) which is threaded though guide-ways in the injection-molded carriage/valve cover and the ends are retained, at each end by buckles as used on 3M 6000 series Gas & Vapor respirator. These buckles are then in turn fitted into suitable features in an injection molded head cradle/pad.

To complete assembly of the mask, filters like those generally described in U.S. patent application Ser. No. 10/719,959 filed Nov. 21, 2003, entitled "Respiratory Facepiece And Method Of Making A Facepiece Using Separate Molds," were attached to the mask body by using a 3-lobed bayonet connection, inserted from inside the cup into the filter base. These filters contained activated carbon and were nominally 100 mm by 70 mm and obloid in shape. A foam nose bridge element was also positioned symmetrically in the narrow nose region of the mask body. The open-cell Polyether polyurethane foam (FT-40S Foam Techniques, Wellingbrough, UK) was 120 mm long by 20 mm wide and 7 mm thick and was attached to the inner surface of the cup with an adhesive.

Figure 4:
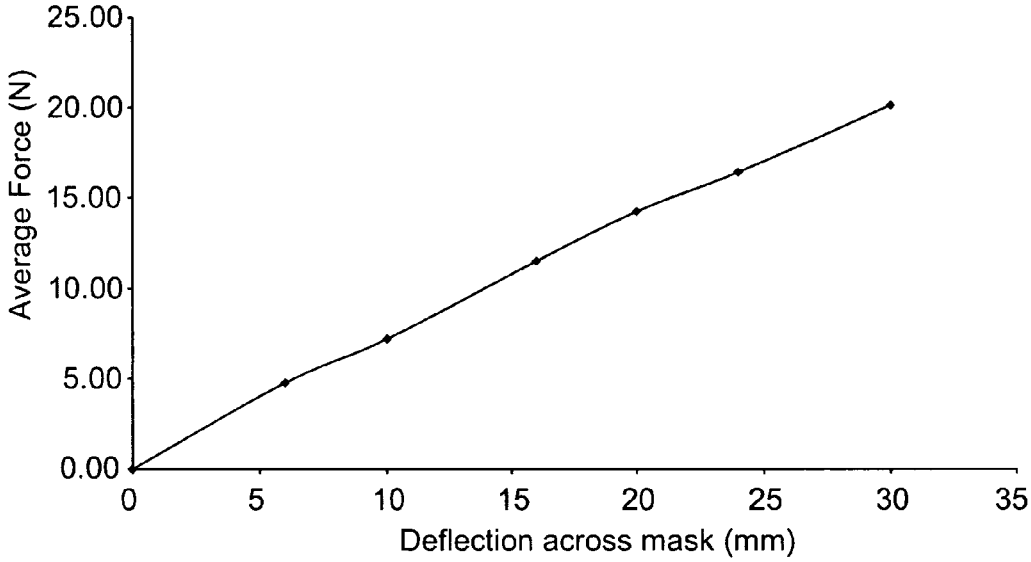
FIG. 4 is a graph that illustrates the deflection of the cheek portions in millimeters (mm) in response to a force that is applied at the nose and chin areas of the mask.

The respiratory mask was successfully tested for facial leakage on an exercising subject according to European Standard EN 405:2001. Fit of the assembled mask was benefited by the clamping action of the mask body when loaded on a wearer's face. Deflection measurements for average results of 3 masks under loading, as might be expected when the mask is worn, are shown in FIG. 4. As is illustrated, a mask of the invention has a clamping deflection that would advantageously benefit the wearer. The mask body is additionally of lighter mass than conventional elastomeric masks and can be made simply, that is, by vacuum forming processes, with a simple universal-fitting shape.

This invention may be suitably practiced in the absence of any element not specifically disclosed herein.

All patents and patent applications cited above, including those in the Background section, are incorporated by reference into this document in total.

This invention may take on various modifications and alterations without departing from the spirit and scope thereof. Accordingly, it is to be understood that this invention is not to be limited to the above-described but is to be controlled by the limitations set forth in the following claims and any equivalents thereof.

What is claimed is:

1. A respiratory mask that comprises:

(a) mask body that lacks a rigid insert, that is non-elastomeric, and that is adapted for fitting over a person's nose and mouth, the mask body having a nose portion, a chin portion, first and second cheek portions, and an axis that extends from the nose portion to the chin portion, the mask body being constructed to deform such that the first and second cheek portions can move towards each other about the axis when the mask body is held stationary and a force is exerted on the nose and chin portions;

(b) a harness that assists in supporting the mask on a wearer's face; and (c) one or more locations on the mask body for attaching one or more filter cartridges.

2. The respiratory mask of claim 1, wherein the mask includes first and second filter cartridges that are secured to the first and second cheek portions, respectively.

3. The respiratory mask of claim 2, further comprising an exhalation valve that is located at a central portion of the mask body, and wherein the harness includes a carriage and at least one strap, the carriage covering the exhalation valve and being secured to the mask body at the central portion.

4. The respiratory mask of claim 1, wherein the first and second cheek portions are capable of deflecting inward during normal jaw movement of the wearer.

5. The respiratory mask of claim 1, wherein the harness includes a carriage and at least one strap, the strap(s) being joined to the carriage, and the carriage being centrally mounted to the mask body, the first and second cheek portions of the mask body being capable of being deflected inwards toward the respective cheeks on a wearer in response to tension from the strap(s) when the mask is being worn.

6. The respiratory mask of claim 5, further comprising first and second filter cartridges that are secured to the first and second cheek portions of the mask body, wherein the first and second filter cartridges move inwardly with the first and second cheek portions when deflection occurs as a result of a force exerted on the nose and chin portions from tension on the at least one strap when the mask is worn.

7. The respiratory mask of claim 5, wherein the strap(s) is capable of applying a force of about 10 to 20 N when the mask is fitted on a wearer's face.

8. The respiratory mask of claim 1, wherein the mask body further includes a soft deformable material as a face seal, which soft deformable material is secured to a perimeter of the mask body to improve fit of the mask body to a person's face.

9. The respiratory mask of claim 8, wherein the mask body has a foam material secured to the interior of the mask body at the nose portion.

10. The respiratory mask of claim 1, wherein the mask body has a mechanism that allows for attachment of a powered air supply source.

11. The respiratory mask of claim 1, wherein the mask body has an elongation at its elastic limit of less than about 5 percent.

12. The respiratory mask of claim 1, wherein the mask body has an elongation at its elastic limit of less than about 2 percent.

13. The respiratory mask of claim 1, wherein the mask body has an elongation at its elastic limit of less than about 1 percent.

14. The respiratory mask of claim 1, wherein the material from which the mask body is made has a flexural modulus greater than 50 MPa.

15. The respiratory mask of claim 14, wherein the material from which the mask body is made has a flexural modulus greater than 500 MPa.

16. The respiratory mask of claim 15, wherein the material from which the mask body is made has a flexural modulus greater than 1000 MPa.

17. The respiratory mask of claim 16, wherein the material from which the mask body is made has a flexural modulus less than about 4000 MPa.

18. The respiratory mask of claim 1, wherein the mask body is capable of exhibiting a deflection of at least 5 mm when an average force of 5 N is applied to the mask body in accordance with the mask body deflection test.

19. The respiratory mask of claim 1, wherein the mask body is capable of exhibiting a deflection of at least 10 mm when an average force of 5 N is applied to the mask body in accordance with the mask body deflection test.

20. The respiratory mask of claim 1, wherein the mask body in naked form does not weigh more than about 35 grams.

21. The respiratory mask of claim 1, wherein the mask body in naked form does not weigh more than 30 grams.

22. The respiratory mask of claim 1, wherein the mask body in naked form does not weigh more than 25 grams.

23. The respiratory mask of claim 22, wherein the mask body in naked form does not weigh more than 10 grams.

24. The respiratory mask of claim 1, wherein the mask body has an average thickness less than about 2 mm.

25. The respiratory mask of claim 1, wherein the mask body has an average thickness less than 1.6 mm.

26. The respiratory mask of claim 1, wherein the mask body has an average thickness less than 1.2 mm.

27. The respiratory mask of claim 26, wherein the mask body has an average thickness greater than about 0.5 mm.

28. The respiratory mask of claim 1, wherein the mask body is constructed from a thermoformed plastic.

29. The respiratory mask of claim 28, wherein the thermoformed plastic comprises polypropylene.

30. The respiratory mask of claim 1, wherein the mask body in naked form weighs less than 35 g, has an average thickness less than 2 mm, and has a flexural modulus greater than 500 MPa.

31. A mask body that lacks a rigid insert, that is non-elastomeric, and that is adapted for fitting over a person's nose and mouth, the mask body comprising a nose portion, a chin portion, first and second cheek portions, and an axis that extends from the nose portion to the chin portion, the mask body further comprising one or more locations for attachment of one or more filter cartridges and being constructed to deform such that the first and second cheek portions can move towards each other about the axis when a force is exerted.

32. A method of making a respiratory mask, which method comprises:

forming a mask body not weighing more than 35 g from a non-elastomeric plastic material that has a flexural modulus of greater than 500 MPa, the non-elastomeric plastic material being formed to a cup shape that has an average thickness less than 2 mm and that is adapted for fitting over a person's nose and mouth without inclusion of a rigid insert but with an integrally-formed nose portion, chin portion, central portion, and first and second cheek portions;

securing a harness to the mask body; and providing one or more locations in the mask body for the securement of one or more filter cartridges.

33. The method of claim 32, wherein the mask body exhibits a deflection of at least 5 mm when a force of 5 N is applied to the mask body when tested in accordance with the Mask Body Deflection Test.

* * * * *

UNITED STATES PATENT AND TRADEMARK OFFICE

CERTIFICATE OF CORRECTION

PATENT NO. : 8,104,472 B2
APPLICATION NO. : 10/810958
DATED : January 31, 2012
INVENTOR(S) : Christopher P Henderson It is certified that error appears in the above-identified patent and that said Letters Patent is hereby corrected as shown below:

(Specification), Column 5

Lines 34-35 delete "cartridge(s) see," and insert -- cartridge(s)—see, --, therefor.

Signed and Sealed this
Eighth Day of May, 2012

David J. Kappos

David J. Kappos
*Director of the United States Patent and Trademark Office*